United States Patent [19]

Hildebrandt

[11] Patent Number: 4,860,391

[45] Date of Patent: Aug. 29, 1989

[54] ARRANGEMENT FOR TREATMENT OF HAIR WITH CIRCULATING LIQUID

[75] Inventor: Bodo Hildebrandt, Riedstadt, Fed. Rep. of Germany

[73] Assignee: Wella Aktiengesellschaft, Darmstadt, Fed. Rep. of Germany

[21] Appl. No.: 133,281

[22] Filed: Dec. 10, 1987

[30] Foreign Application Priority Data

Dec. 19, 1986 [DE] Fed. Rep. of Germany ..... 3643417

[51] Int. Cl.[4] ..... A45D 19/00

[52] U.S. Cl. ..... 4/518; 4/516

[58] Field of Search ..... 4/515, 518, 516, 517, 4/519; 132/1 R; 604/150, 151; 417/313, 411, 360, 36; 134/93, 115 R, 4, 132, 604, 417

[56] References Cited

U.S. PATENT DOCUMENTS

| | | | |
|---|---|---|---|
| 2,076,688 | 4/1937 | West | 4/518 |
| 3,979,096 | 9/1976 | Zieger | 4/615 |
| 4,218,195 | 8/1980 | Shure | 417/411 |
| 4,484,862 | 11/1984 | Jensen | 417/36 |

FOREIGN PATENT DOCUMENTS 8532878 2/1986 Fed. Rep. of Germany .

*Primary Examiner*—Henry J. Recla
*Assistant Examiner*—J. Casimer Jacyna
*Attorney, Agent, or Firm*—Michael J. Striker

[57] ABSTRACT

An arrangement for treatment of hair with circulating liquid comprises a circulating pump unit provided with a pump and having a suction opening and a discharge opening. A foot is to seal an opening of a flushing basin and formed as a plug matching with the opening of the flushing basin.

20 Claims, 4 Drawing Sheets

FIG. 3
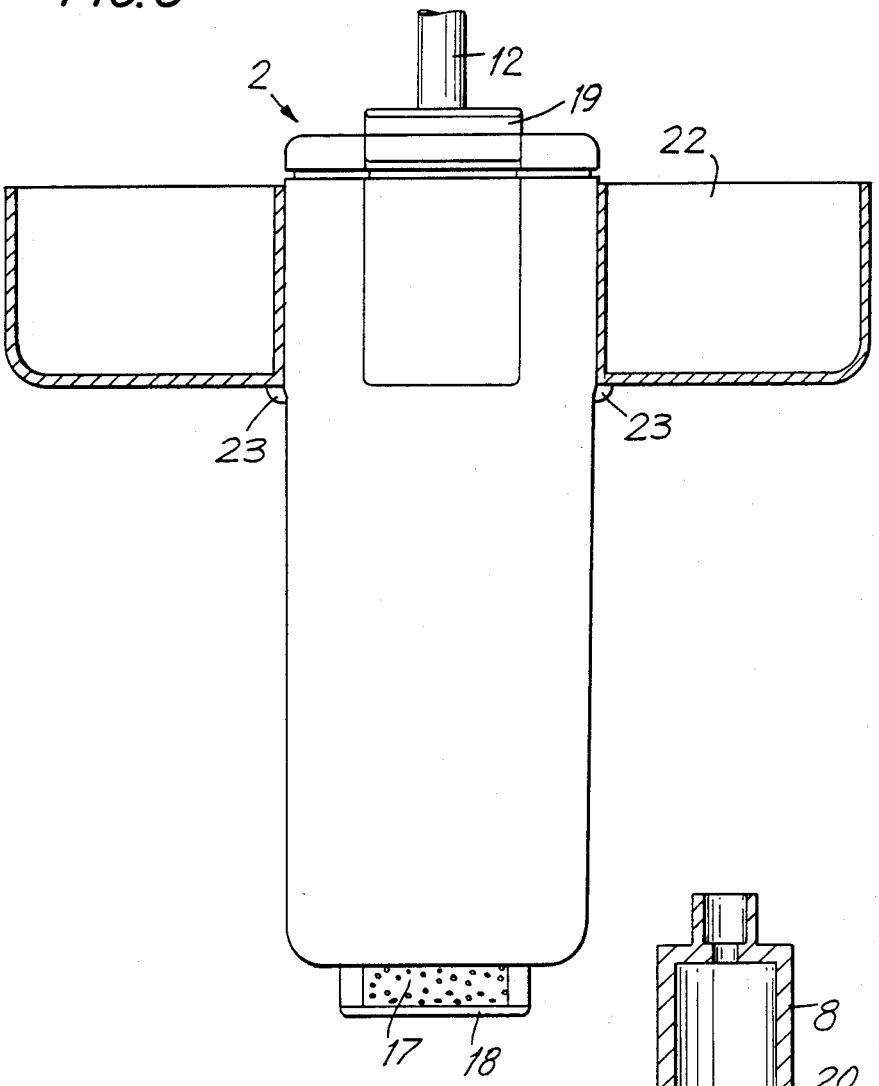
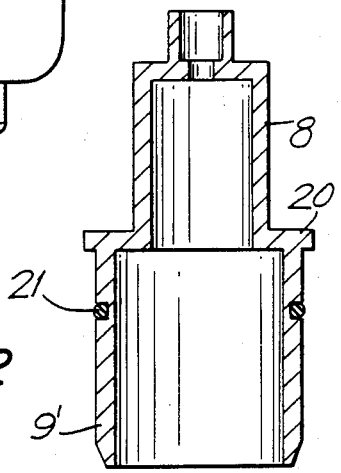
FIG. 2

FIG. 4
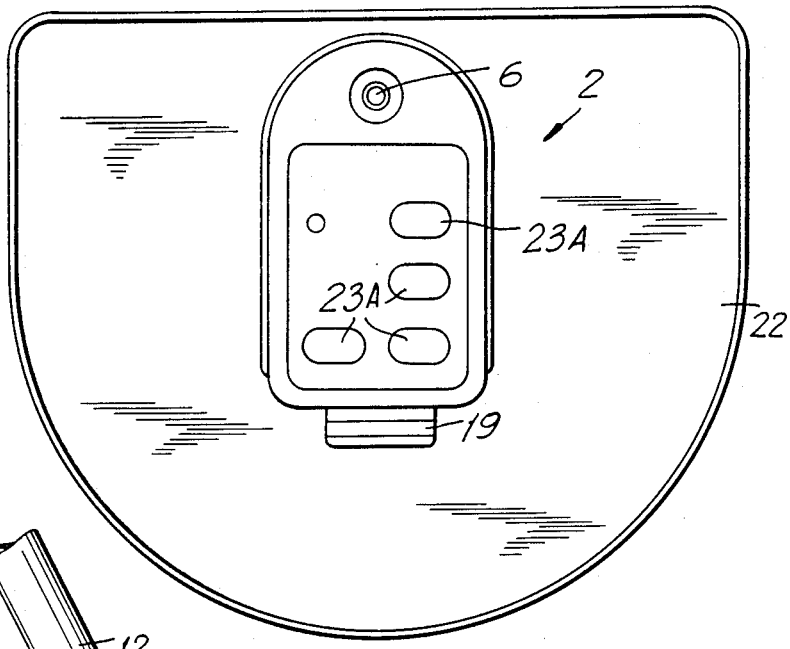
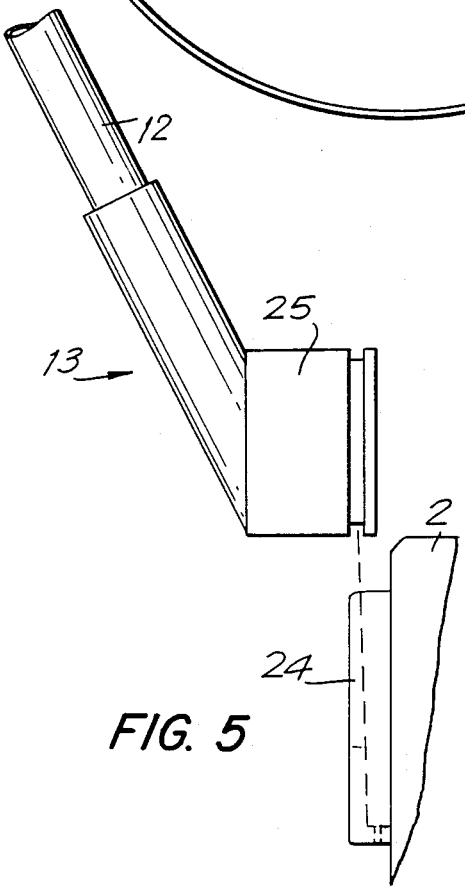
FIG. 5
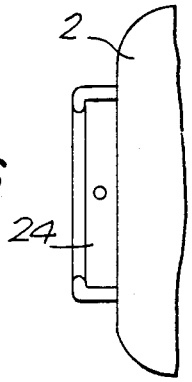
FIG. 6

ARRANGEMENT FOR TREATMENT OF HAIR WITH CIRCULATING LIQUID

BACKGROUND OF THE INVENTION

The present invention relates to an arrangement for treatment of hair by means of a liquid in a circulating process. More particularly, it relates to such an arrangement which has a circulating pump unit with a pump which is driven by an electric motor integrated in the unit, wherein the circulating pump unit has a suction opening and a discharge opening and at its lower end seals with a foot a discharge opening of a flushing basin.

Arrangements of the above mentioned general type are known in the art. One such arrangement is disclosed in the German Gebrauchsmuster G No. 8,532,878. The arrangement disclosed in this reference has several feet, and one foot is provided with a suction opening and seals a discharge opening of a flushing basin. The disadvantage of this construction is that the foot with the suction opening must be positioned by hand in a very complicated manner for sealing the discharge opening of the flushing basin so that a sealing is achieved by the placing force of the foot. In the event of improper positioning of the foot and dirtying of the discharge opening or the foot with the suction opening, a 100% sealing can no longer be guaranteed. This can lead to an uncontrollable discharge of the treatment liquid so that the remaining liquid can reach during circulation an increased rinsing concentration which is disadvantageous for the hair treatment results.

SUMMARY OF THE INVENTION

Accordingly, it is an object of the present invention to provide an arrangement of the above mentioned general type, which avoids the disadvantages of the prior art and is more favorable to use.

In keeping with these objects and with others which will become apparent hereinafter, one feature of the present invention resides, briefly stated, in that the foot of the circulating pump unit is formed as a plug which matches to the discharge opening of the flushing basin.

When the arrangement is designed in accordance with the present invention it eliminates the disadvantages of the prior art.

The arrangement in accordance with the present invention can serve for example for permanent treatment for fixing the permanent waves by means of a fixing liquid in a circulating process. A further use for example can be the hair treatment by means of a medication liquid. With the use of the plug which matched to the discharge opening of the flushing basin, the arrangement in accordance with the present invention can be connected fast and in an intended manner with the discharge opening in a liquid-tight manner.

In accordance with an advantageous feature of the present invention, the plug is formed so that it freely supports the inventive arrangement.

The plug can be connected with the circulating pump unit in a releasable manner. In this construction, the arrangement can easily be adjusted to different discharge openings of flushing basins.

Especially for the fixing treatment it is of advantage when the circulating pump unit is provided at its upper end with a storage which serves practically for supporting of unrolled curl rolls. This storage can be removed from the circulating pump unit for cleaning and during periods of non-use.

A removable filter for example of a foam material can be arranged in the suction opening of the circulating unit. It can be removed for cleaning or exchange.

During periods of non-use a hose receptacle provided in the circulating pump unit can be used for storing a hand-held shower head. In accordance with another embodiment, the circulating unit has a shower head receptacle which directly receives the shower head. This shower head receptacle can be formed fork-shaped and designed so as to provide a clamping connection.

For providing a predetermined quantity of the treatment liquid or for adjusting to different flushing basins, an adjustable liquid level marking is installed in the inventive arrangement.

Control of the temperature of the treatment liquid is performed by a thermometer. Thereby an optimum treatment is possible since the treatment liquid temperature influences the treatment time. When the height of the circulating pump unit is dimensioned so that the upper part is located above the treatment liquid level, the arrangement can be used without contacting the fingers with the treatment liquid. It is especially advantageous when the upper part is provided with control elements preferably in fluid-tight arrangement. Thereby the control elements are located above the treatment liquid level and can be activated without contact with the treatment liquid.

When the arrangement is not used, the circulating pump unit in accordance with the present invention can be placed on a supporting device. The supporting device can be provided with a collecting container for catching a dripping liquid. The accumulated liquid can be emptied by tilting the collecting container.

In accordance with a further advantageous embodiment of the invention, the supporting device is provided with an accumulator charging device. The supporting device with the accumulator charging device is formed so that by placing the circulating unit in the supporting device, a charging communication is established. For example, the charging contacts of the supporting device are brought in communication with the charging contacts of the circulating pump unit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a view showing another plug for matching to another discharge opening of the flushing basin;

FIG. 3 is a side view of a part of the arrangement in accordance with the present invention, turned axially by 90° relative to the view of FIG. 1, and showing a storage in section;

FIG. 4 is a plan view of the circulating pump unit of FIG. 3 on a reduced scale;

FIG. 5 is a view showing a fragment of the circulating pump unit with a shower head receptacle;

FIG. 6 is a plan view of the fragment of the circulating pump unit with the shower head receptacle of FIG. 5.

DESCRIPTION OF A PREFERRED EMBODIMENT

Figure 1:
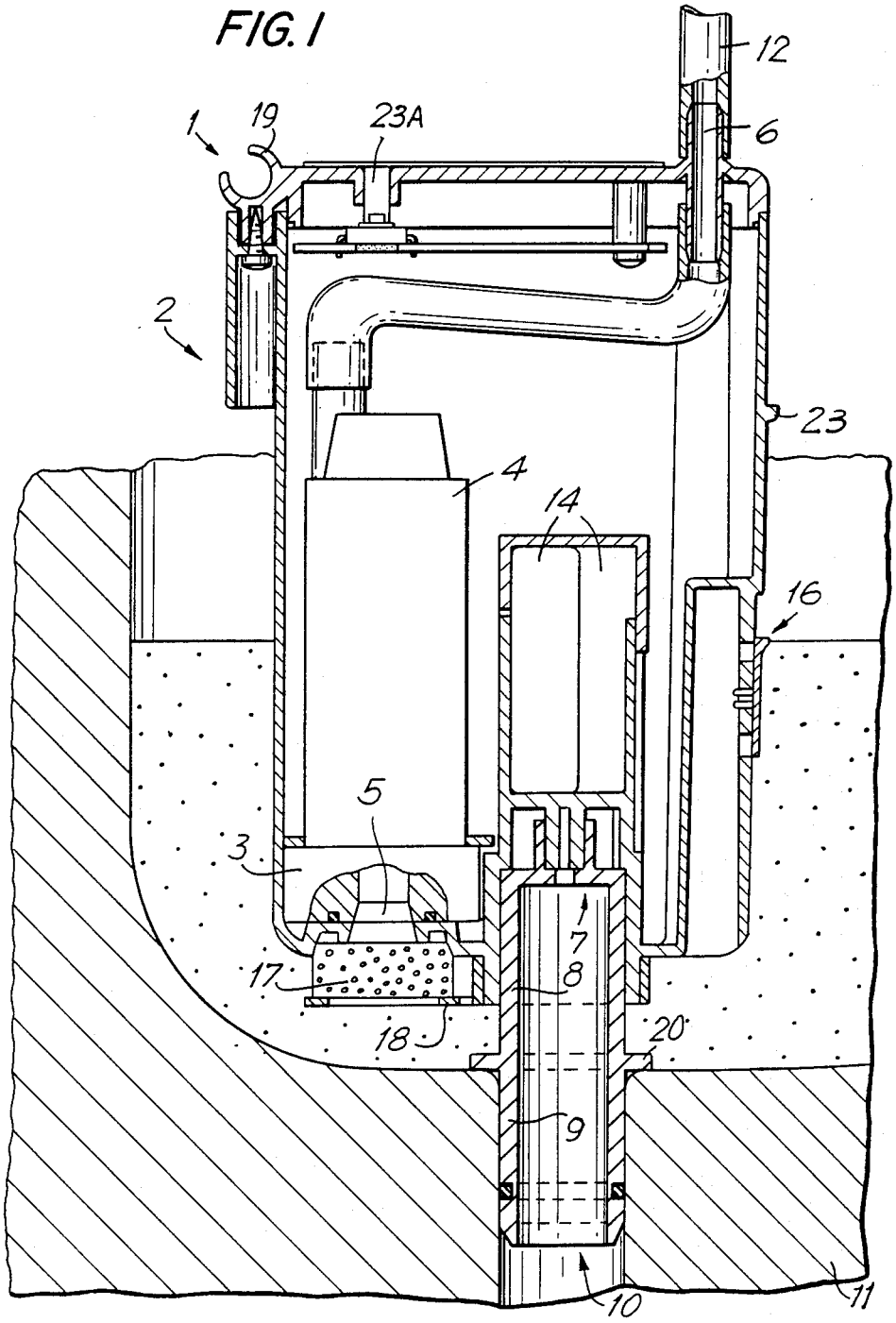
FIG. 1 is a sectioned side view of an arrangement for treatment of hair in accordance with the present invention in a working position with a freely supporting connection between a circulating pump unit and a discharge opening of a flushing basin by means of a plug.

FIG. 1 shows in section a part of an arrangement for treatment of hair in accordance with the invention, identified with reference numeral 1. Reference numeral 2 identifies a circulating pump unit 2 which is shown on a side view and has a pump 3 and an electric motor 4 for driving the pump integrated in the unit. The circulating pump unit 2 has a suction opening 5 and a discharge opening 6.

The lower end of the circulating pump unit 2 is provided with a receptacle 7 for a foot 8. The foot 8 is formed as a plug 9. A free carrying connection of the circulating pump unit 2 with a discharge opening 10 of a flushing basin 11 is performed exclusively by the foot 8. The discharge opening 6 is provided at its outer side with a hose 12. The end of the hose 12 is connected with a hand-held shower head 13 shown in FIGS. 5 and 7. For driving the electric motor 4, the circulating pump unit 2 is provided with integrated accumulators 14 which selectively can be charged from outside or removed for charging with suitable constructions.

For adjusting to a predetermined quantity of a liquid 15 in the flushing basin 11, an adjustable treatment liquid marking 16 is provided. A filter 17 is arranged under the suction opening 5 and held by a member 18 which is turnable about an axis of the foot. A fork-shaped hose receiver is arranged above the circulating pump unit 2 for fixing the hand-held shower head 13 by means of the hose 12 on the circulating pump unit 2 during the periods of non-use of the arrangement 1. An outer radially extending ring 25 is provided on the plug 9 for limiting the plug in the discharge opening 10. The foot 8 must naturally be formed so that the connection to the circulating pump unit 2 is greater than the connection with the discharge opening 10. The upper part of the circulating pump unit 2 have control elements 23A for controlling the electric motor 4.

FIG. 2 shows an axial section of a different foot 8' with a plug 9' for another not shown discharge opening. For an increased liquid tightness, the plug is provided with a sealing ring 21.

FIG. 3 shows a side view of the circulating pump unit 2 with a storage 22 which is fitted on it and limited by ribs 23. This storage serves for example for depositing of unrolled curl rolls and can be designed differently in accordance with respective requirements. For better understanding of the storage 22, it is shown in FIG. 4 together with the circulating pump unit 2 on a plan view. The storage 22 can advantageously be designed so that it extends to the edge of the flushing basin in the region of the discharge opening 10.

FIG. 5 shows a hand-held shower head receptacle 24 in a cut-out of the circulating pump unit 2. It is formed so that it receives the front part of a shower head 25 in a fork-like manner, for example in clamping connection. FIG. 6 shows a plan view of the shower head receptacle 24.

Figure 7:
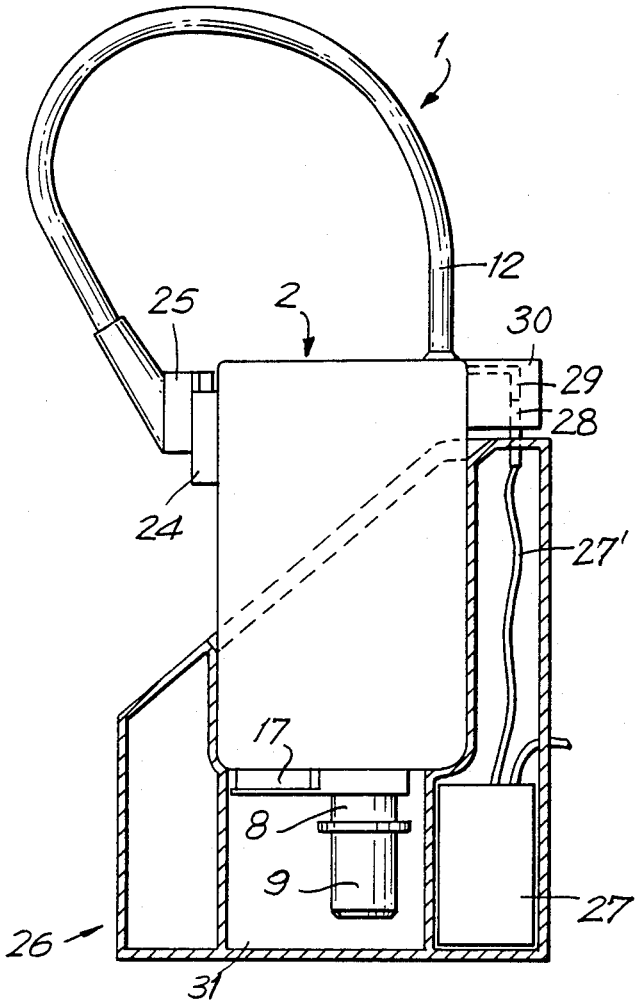
FIG. 7 is a view showing the arrangement in accordance with the present invention during non-use, with a supporting device shown in section.

FIG. 7 shows a section of a supporting device 26 in which the arrangement 1 with the foot 8 is supported. In this position the arrangement 1 can be supported during periods of non-use. Simultaneously the accumulators 14 can be charged by means of an accumulator charging device 27. For this purpose the supporting device 26 is provided with charging contacts 28 connected by a conductor 27' with the accumulation charging device and communicates with charging contacts 29 of the circulating pump unit 2 so that the contacts 28 and 29 are in current conducting communication under the action of the weight of the circulating pump unit 2. The circulating pump unit is provided at its upper end with a cup-shaped projection 30 in which the charging contacts 29 are arranged. The charging contacts 29 are connected with the accumulators 14 which are integrated in the circulating pump unit. The cup-shaped design of the projection 30 has the advantage that it protects the contacts 29 from flushing water. For collecting dripping residual water from the circular pump unit, a liquid collecting container 31 is provided in the supporting device 26.

It is to be understood that the foot 8 can be curved so that the circularing pump unit 2 is positioned near the edge of the flushing basin 11.

It will be understood that each of the elements described above, or two or more together, may also find a useful application in other types of constructions differing from the types described above.

While the invention has been illustrated and described as embodied in an arrangement for treatment of hair with circulating liquid, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for treatment of hair with circulating liquid held in a flushing basis having a drain opening, comprising a circulating pump unit provided with a pump and having a suction opening and a discharge opening adapted to be connected to a liquid discharge member for treating hair; and a foot including plug means insertable into said opening and arranged to seal said opening of a flushing basin said plug means being formed so as to provide a sole support for said circulating pump unit with respect to the opening of the flushing basin.

2. An arrangement as defined in claim 1, wherein said circulating pump unit is provided with an electric motor which drives said pump.

3. An arrangement as defined in claim 1, wherein said plug is releasably connected with said circulating pump unit.

4. An arrangement as defined in claim 1, wherein said circulating pump unit has lower and upper ends, said plug being provided on said lower end of said circulating pump unit.

5. An arrangement as defined in claim 4, wherein said circulating pump unit has lower and upper ends; and further comprising a storage arranged on said upper end of said circulating pump unit.

6. An arrangement as defined in claim 5, wherein said storage is releasably connected with said circulating pump unit.

7. An arrangement as defined in claim 1, wherein said circulating unit is provided with a removable filter which is arranged in the region of said suction opening.

8. An arrangement as defined in claim 1, wherein said circulating pump unit is provided with a hose receptacle.

9. An arrangement as defined in claim 1, wherein said circulating pump unit is provided with a shower head receiver.

10. An arrangement as defined in claim 9, wherein said circulating unit is provided with a shower head, said shower head receiver being formed so as to receive said shower head.

11. An arrangement as defined in claim 10, wherein said shower head receiver is formed so as to clampingly receive said shower head.

12. An arrangement as defined in claim 1, wherein said circulating pump unit is provided with an adjustable liquid level marking.

13. An arrangement as defined in claim 1, wherein said circulating pump unit has an upper part and formed so that said upper part is arranged above a treatment liquid level in the flushing basin.

14. An arrangement as defined in claim 13, wherein said upper part of said circulating pump unit is provided with control elements.

15. An arrangement as defined in claim 1; and further comprising a supporting device for supporting said circulating pump unit.

16. An arrangement as defined in claim 15, wherein said supporting device is provided with a container for collecting a residual liquid.

17. An arrangement as defined in claim 15, wherein said supporting device is provided with accumulator charging means.

18. An arrangement as defined in claim 1, wherein said plug is provided with a sealing ring and so that when said is inserted in the opening of the flushing basin said sealing ring is located between an outer surface of the plug and an inner surface of the opening of the flushing basin.

19. An arrangement as defined in claim 1, wherein said plug is removably connected with said circularing pump unit so as to be exchanged by another plug to match with another opening of the flushing basin.

20. An arrangement for treatment of hair with circulating liquid, comprising a circulating pump unit provided with a pump and having a suction opening and a discharge opening; a foot arranged to seal an opening of a flushing basin, said foot being formed as a plug arranged to match with the opening of the flushing basin; a supporting device for supporting said circulating pump unit and provided with accumulator charging means, said circulating pump unit being provided with charging contacts, said supporting device being also provided with charging contacts and formed so that when said circulating pump unit is supported by said supporting device, said charging contacts of said supporting device and the charging contacts of said circulating pump unit are in a charging communication with one another.

* * * * *